US008403513B2

(12) United States Patent
Drury

(10) Patent No.: US 8,403,513 B2
(45) Date of Patent: Mar. 26, 2013

(54) POOL LIGHT ADAPTER RING

(75) Inventor: William J. Drury, Peachtree City, GA (US)

(73) Assignee: Custom Molded Products, Inc., Newnan, GA (US)

( * ) Notice: Subject to any disclaimer, the term of this patent is extended or adjusted under 35 U.S.C. 154(b) by 105 days.

(21) Appl. No.: 13/205,683

(22) Filed: Aug. 9, 2011

(65) Prior Publication Data

US 2013/0039037 A1 Feb. 14, 2013

(51) Int. Cl.
*F21V 33/00* (2006.01)

(52) U.S. Cl. ..... 362/101; 362/267; 362/363; 362/396; 362/440; 362/443; 248/200; 248/74.1; 248/74.4

(58) Field of Classification Search ..... 362/147, 362/101, 267, 365, 363, 364, 440, 443; 248/200, 248/74.1, 74.4
See application file for complete search history.

(56) References Cited

U.S. PATENT DOCUMENTS

| | | | | |
|---|---|---|---|---|
| 4,557,447 | A * | 12/1985 | Combe | 248/74.1 |
| 4,767,087 | A * | 8/1988 | Combu | 248/62 |
| 6,250,776 | B1 * | 6/2001 | Burkitt et al. | 362/267 |
| 6,616,291 | B1 * | 9/2003 | Love | 362/101 |
| 7,204,602 | B2 * | 4/2007 | Archer | 362/101 |
| 7,244,037 | B2 * | 7/2007 | Koren | 362/101 |
| 7,364,323 | B2 * | 4/2008 | Francois | 362/267 |
| 7,603,752 | B2 * | 10/2009 | Heath et al. | 24/25 |
| 7,722,208 | B1 * | 5/2010 | Dupre et al. | 362/147 |
| 8,079,738 | B1 * | 12/2011 | Schlappi et al. | 362/375 |

* cited by examiner

*Primary Examiner* — Ali Alavi
(74) *Attorney, Agent, or Firm* — Laurence P. Colton; Smith Risley Tempel Santos LLC

(57) ABSTRACT

A pool light adapter ring for retrofitting a pool light in a pool wall niche. The adapter ring has a pair of interlocking hooks to allow the ring to be compressed to a first, compressed state, inserted into a wall niche and then relaxed to a second, rigid state. The adapter ring has mounting brackets attached to the ring for receipt of a pool light or other device. The adapter ring also has a plurality of anchor screws for securing the adapter ring inside the niche. Further, some embodiments may include a grounding screw for attaching the grounding wire from the pool light.

19 Claims, 4 Drawing Sheets

POOL LIGHT ADAPTER RING

BACKGROUND OF THE INVENTION

1. Technical Field

This invention relates generally to the field of accessories for water features, and more specifically to underwater lighting accessories for use in ponds, pools, fountains, spas, and the like.

2. Prior Art

Underwater lighting is used in pools, spas, and ornamental water features for both safety and decorative purposes. For example, a well lit pool enables lifeguards and other responsible parties to clearly see beneath the water's surface and easily monitor user activity. Additionally, the same underwater lighting that ensures user safety can also give the pool a pleasant decorative appearance. Ponds and fountains utilize underwater lighting accessories for visual and aesthetic enhancement.

The benefit of underwater lighting, whether for safety or aesthetics, is readily apparent to those who own pools or other water features. What may not be apparent, however, is the ongoing maintenance challenge of keeping an electrical device such as a pool light in proper working order. Almost as soon as underwater lighting sources are put into service, the harmful effects of water and chlorine start to take a toll on the delicate electronics within. Not surprisingly, therefore, most lighting systems must be repaired or outright replaced numerous times over the life of the water feature.

When it comes to pools, most lighting systems are designed to be accommodated by a recess, or niche, in a vertical wall of the pool. Once received by a niche, the faces of the lights are ideally flush, or nearly flush, with the pool wall. Unfortunately, it can be difficult to properly mount replacement lights flush to a pool wall because the niche may not have retained its initial shape. For example, it is common for the profile of pool light niches to change in shape as a result of corrosion from pool chemistry or settling attributable to shifting soil. Consequently, a niche with a compromised shape profile can make it difficult for mounting hardware systems to securely support replacement lights. Subsequent shifting and movement of a replacement light due to ill-fitted mounting hardware may direct light away from an intended area of the pool or create unnecessary pinch points along the rim of the niche.

Accordingly, there is a need for a replacement lighting system having mounting hardware that will allow the replacement light to be installed in a secure and stable manner despite the changing conditions of the wall recess. It is to this need and others that the present invention is directed.

BRIEF SUMMARY OF THE INVENTION

Briefly, the present invention, as well as features and aspects thereof, are directed towards a replacement pool light adapter ring. One exemplary embodiment of a replacement pool light adapter ring includes a ring manufactured from a metal that is pliant, yet durable. Embodiments of the adapter ring are constructed of stainless steel, or a metal of similar tensile strength, ductility and corrosion resistance, although it is envisioned that the pool light adapter ring may be constructed of any material, or combination of materials, suitable for underwater applications.

The adapter ring may be discontinuous at one or more points along its circumference in order to allow the ring to be compressed to a size smaller than the full diameter. Advantageously, when in a compressed state, embodiments of the pool light adapter ring may be easily inserted into a niche that is substantially the same diameter as the ring when in an uncompressed state.

In one exemplary embodiment, the opposing ends of the opening of the ring may be connected via a pair of interlocking hooks. The interlocking hooks may be disengaged when the diameter of the adapter ring is compressed, thereby enabling the ring to be inserted with minimal interference into a wall niche. Once positioned in the niche, the adapter ring may be allowed to relax to its full diameter such that the interlocking hooks re-engage. In some embodiments, the engaged hooks may be secured with a retaining bolt that is simultaneously threaded through aligned, tapped holes in the respective centers of the hooks.

Further, some embodiments of the pool light adapter ring may include two or more mounting brackets affixed along the circumference of the ring and extending substantially perpendicular to the plane that is defined by the circumference. In some embodiments, these brackets may be located on opposite sides of the ring, generally opposing one another, although the positioning of the brackets is not a limiting factor on the scope of the pool light adapter ring. For example, in some embodiments, the brackets may each be located along the circumference of the ring at thirty degree increments, forty-five degree increments, sixty degree increments or any combination of increments that may occur to one of ordinary skill in the art. In some embodiments, the brackets may generally take the form of an "L" having a free end leg portion that is positioned substantially parallel to the plane defined by the circumference of the ring. Notably, however, one of ordinary skill in the art will recognize that the size, shape and configuration of any given bracket included in an embodiment of the pool light adapter ring may be dictated by a particular application in the field and, as such, the bracket aspects of a given pool light adapter ring embodiment will not limit the scope of the present disclosure.

In one exemplary application of the pool light adapter ring, the ring may be inserted into a niche such that the brackets are positioned flush, or nearly flush, with the wall of the pool in which the niche is located. Once positioned, the adapter ring may be secured in position via a series of anchor screws. The anchor screws may be screwed through threaded holes extending through the flat circumferential surface of the ring. When tightened, the anchor screws may extend outward from the ring until they are secured against the niche wall, thereby creating a rigid structure to which a pool light may be mounted. Advantageously, by leveraging a series of anchor or set screws, a pool light adapter ring may be used to provide a suitable pool light mounting structure in a niche having a compromised shape profile.

Further, some embodiments of the pool light adapter ring may include a grounding screw feature to electrically ground a pool light mounted thereon. It is envisioned that a grounding screw structure may be affixed to the inside surface of the ring and consist of a threaded hole in the ring which will receive a grounding screw capable of retaining a grounding wire, although any grounding mechanism or grounding means known in the art may be included in any given embodiment of the pool light adapter ring.

To use some embodiments of the pool light adapter ring, the user may reduce the pool light adapter ring into a compressed state by removing a retention bolt and decoupling the interlocking hook features that serve to secure the ring into its uncompressed, rigid state. After removing the bolt and decoupling the interlocking hooks, the user may compress the ring into a smaller diameter and slide it into a niche. Once in the niche, the ring can be allowed to expand to a size at which the ring fits snugly in the lighting recess, or the anchor screws can be extended to secure the ring in the lighting recess.

In some applications, the pool light adapter ring may be inserted into the niche such that it is flush, or nearly flush, with the vertical wall of the pool, although it is envisioned that not all pool light adapter rings will be configured for flush positioning with a pool wall. Once the pool light adapter ring is inserted into a niche to the proper depth, the adapter ring may be allowed to relax such that the interlocking hooks reengage and the adapter ring is returned to its uncompressed, rigid state. The interlocking hooks may be secured in the engaged state by screwing a bolt through a pair of aligned holes located, respectively, in the center of each hook. After the adapter ring is relaxed to the uncompressed, rigid state inside the niche, anchor screws may be driven through the surface of the adapter ring and into the niche wall to secure the adapter ring in place.

Once secured in the niche, the adapter ring provides a rigid, secure structure that is ready for receipt of a light or other device.

A complete understanding of the present invention may be obtained by reference to the accompanying drawings, when considered in conjunction with the subsequent, detailed description of preferred embodiments in which like elements and components bear the same designations and numbering throughout the figures.

BRIEF DESCRIPTION OF THE DRAWINGS

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral encompass all parts having the same reference numeral in all figures.

DETAILED DESCRIPTION OF PREFERRED EMBODIMENTS

Aspects, features and advantages of several exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto.

The presently disclosed embodiments, as well as features and aspects thereof, are directed towards providing a pool light adapter ring and a system and method for using the ring. As will become apparent from a review of the drawings and the following description, exemplary embodiments of the pool light adapter ring may allow a user to easily mount and secure a pool light, or other device, inside an existing niche of a pool or spa or other water feature. Notably, although the exemplary applications for a pool light adapter ring are described herein in the context of a pool or spa, one of ordinary skill in the art will recognize that embodiments might be used in any application requiring that a device be mounted, or retrofitted into a niche. Advantageously, embodiments of the pool light adapter ring facilitate the mounting of a pool light into a niche having a compromised or inconsistent shape.

Figure 1:
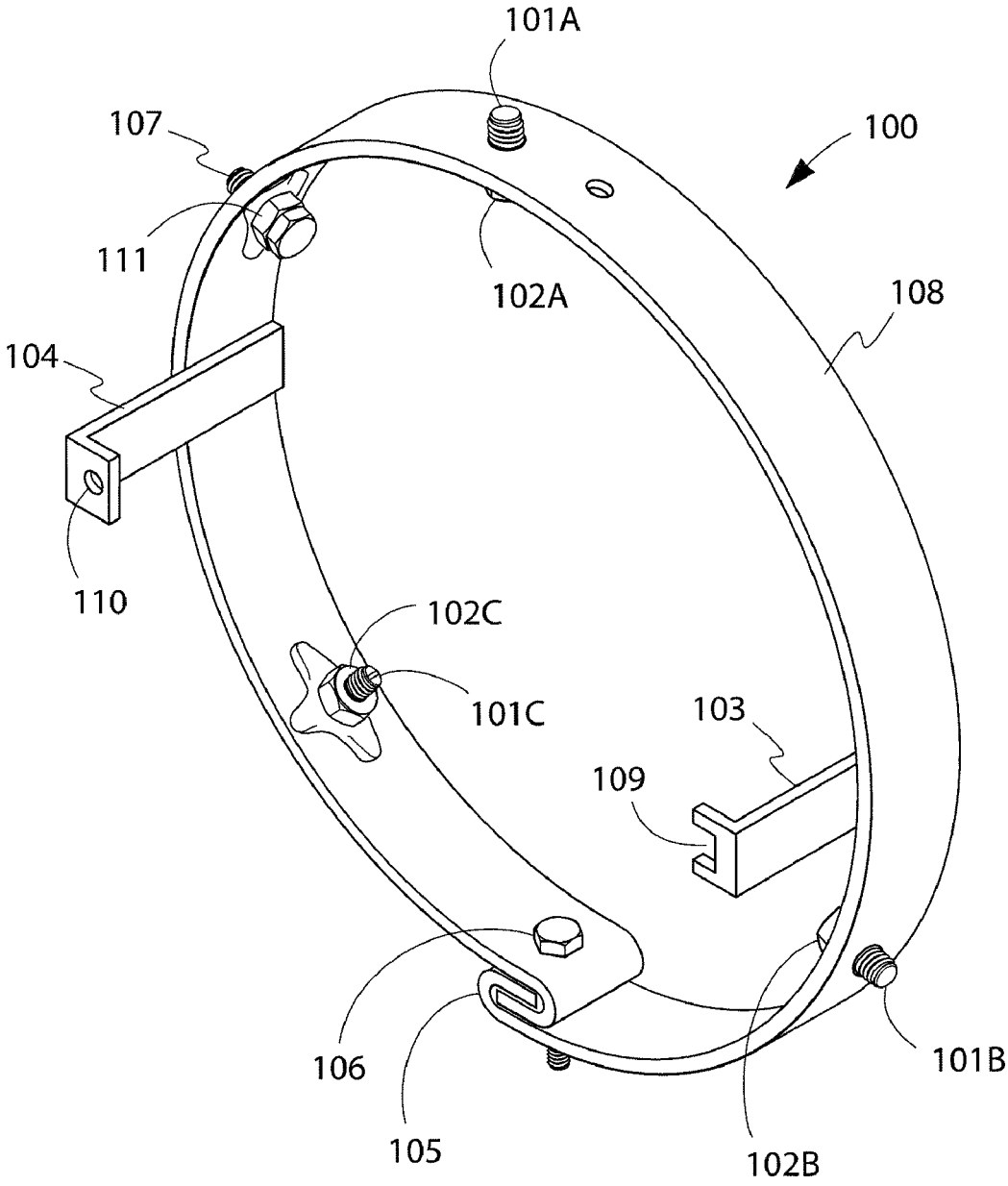
FIG. 1 is a perspective view of an exemplary embodiment of the pool light adapter ring, shown in an uncompressed, rigid state.

FIG. 1 is a perspective view of a pool light adapter ring 100 according to an exemplary embodiment of the invention. The exemplary embodiment of a pool light adapter ring 100 may include a ring band 108 manufactured from a metal that is pliant, yet durable, although it is envisioned that a ring band 108 may be constructed of any material, or combination of materials, suitable for underwater applications. For example, some embodiments include a ring band 108 constructed of stainless steel or a metal of similar tensile strength, ductility and corrosion resistance while other embodiments are envisioned to include a ring band 108 constructed of a ceramic, plastic or fiberglass. The ring band 108 may be discontinuous at one or more locations along its circumference to allow the ring band 108 to be compressed to a size smaller than its full diameter. Advantageously, when the ring band 108 is in a compressed state, the pool light adapter ring 100 may be easily inserted into a niche that is substantially the same diameter as the full diameter of the ring band 108.

Returning to the exemplary embodiment of the pool light adapter ring 100, the opposing ends at the point of discontinuity in the ring band 108 may be disconnected and reconnected via a pair of interlocking hooks 105. When connected, the interlocking hooks 105 may be secured together with a retaining bolt 106 threaded through aligned, tapped holes in the respective centers of the interlocking hooks 105. Moreover, when the interlocking hooks 105 are in communication, the ring band 108 is in an uncompressed, rigid state suitably for rigid mounting within a niche. Notably, although the particular embodiments depicted in the figures include interlocking hooks 105 secured by a retaining bolt 106, one of ordinary skill in the art will recognize that other ring securing mechanisms including, but not limited to, clamps, bolts, snaps, and clips are within the scope of the disclosure.

Further, the exemplary embodiment of the pool light adapter ring 100 may have two mounting brackets 103, 104 affixed preferably to the inner surface of the ring band 108 and extending perpendicular to the plane generally defined by the ring band 108. These brackets 103, 104 may be located on opposite sides of the ring band 108 opposing one another, although other increments of placement are envisioned for other embodiments of a pool light adapter ring. Moreover, it is envisioned that some embodiments may include more or fewer brackets than the exemplary embodiment 100 and, as such, the specific number, size, configuration or placement of bracketry will not be a limiting aspect for a pool light adapter ring that falls within the scope of this disclosure.

The brackets 103, 104 are each located on the ring band 108 approximately 90 degrees from the interlocking hooks 105. The brackets 103, 104 may be bent into a right angle such that the free end of each is roughly parallel to the plane of the ring band 108 and directed back toward the center of the ring band 108. In the exemplary embodiment 100, the first of these two brackets 103 may have a notch 109 cut into the free end leg surface. This notch 109 may serve to accept a mating bolt located on a pool light or other device. The second bracket 104 may have an orifice 110 in the free end surface that may accept a screw, thereby working in conjunction with notch 109 of bracket 103 to provide a means for securing a pool light ring band 108. In other embodiments of the pool light adapter ring, one of ordinary skill in the art will recognize that the orifice 110 and notch 109 may be altered to accommodate the requirements of the specific pool light or device being installed. For example, a pool light or other device may be secured in other embodiments via a clip, bolt, snaps or any equivalent hardware that will mate with the requirements of the pool light or other device.

Further, as indicated in FIG. 1, the exemplary embodiment of the pool light adapter ring 100 may employ a grounding screw 107 to electrically ground a pool light. This grounding screw hardware 107 may consist of a threaded hole 111 in the ring band 108 which will receive a grounding screw 107 capable of retaining a grounding wire. In some embodiments, the threaded hole 111 may be constructed of a nut that will mate to the screw pattern of the grounding screw 107. For example, a retaining nut 111 may be affixed to the ring band 108 by welding, casting, or any other method which will allow a secure and accessible housing for the grounding screw 107.

Additionally, FIG. 1 illustrates three anchor screws 101 located at 120 degree increments around the ring band 108, although other quantities and locations of anchor screws are envisioned for other embodiments. The anchor screws 101 may be screwed through threaded holes 102 extending through the flat surface of the ring band 108. In some embodiments, a threaded hole 102 may be constructed of a nut that will mate to the screw pattern of the anchor screw 101. This nut 102 may be affixed to the ring band 108 by welding, casting, or any other method which will allow a secure and accessible housing for the anchor screws 101. When tightened, the anchor screws 101 may extend outward from the ring band 108 until securely communicating with the niche 200 wall. Notably, by leveraging the anchor screws 101, a user may fix a pool light adapter ring in a position suitable for receipt and alignment of a pool light or other device.

Figure 2:
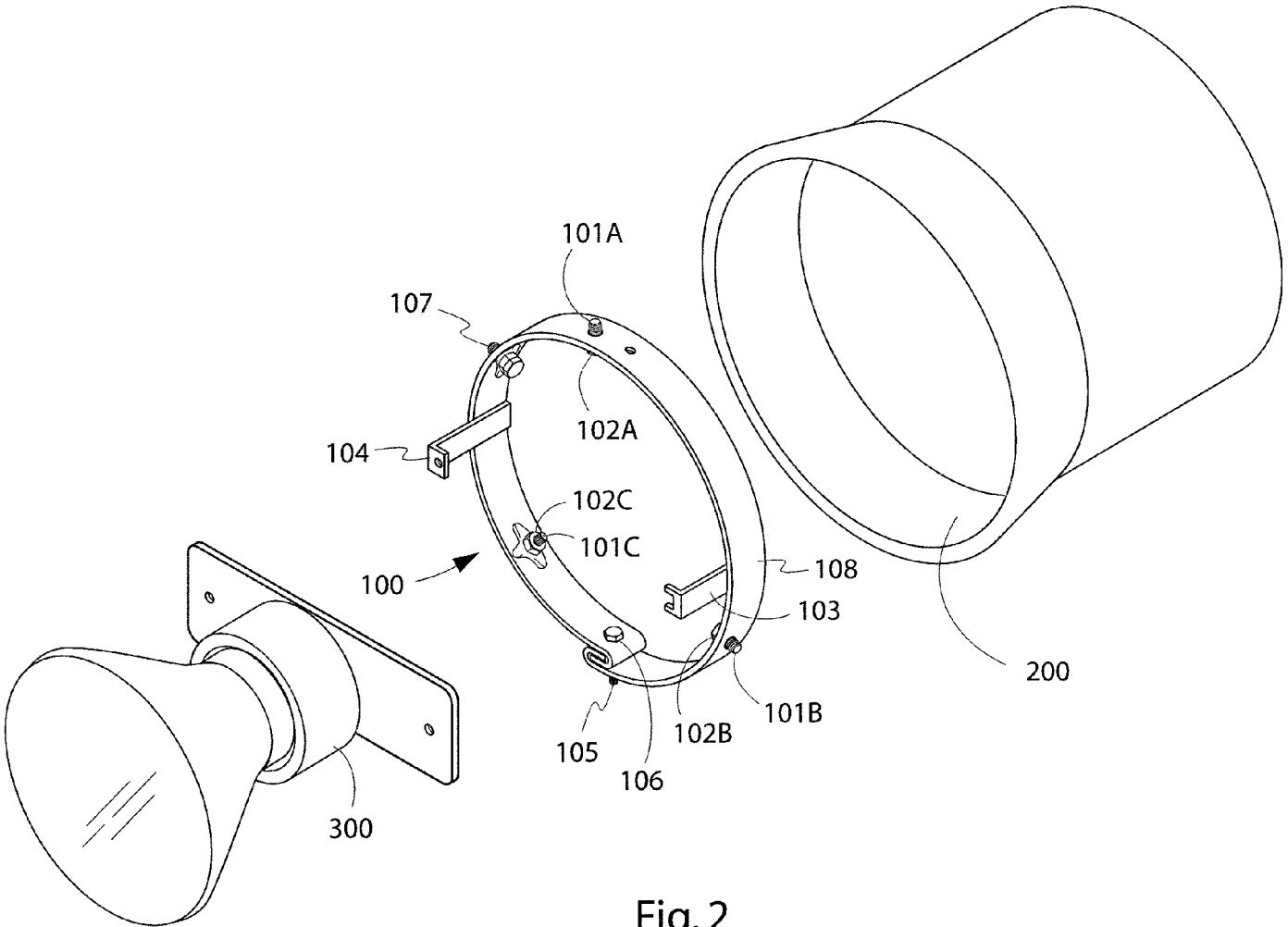
FIG. 2 is an exploded, perspective view of a niche and the exemplary pool light adapter ring of FIG. 1.

FIG. 2 is a perspective view of the pool light adapter ring 100 according to an exemplary embodiment of the invention shown in front of a pool light niche 200 in which the adapter ring 100 might be mounted. As previously described, the ring band 108 may be compressed and then inserted into the niche 200 to a depth such that the completely installed lighting fixture is flush with the vertical wall in which the niche 200 is located. As such, the adapter ring 100 can be moved within the niche 200 to a position most advantageous for the positioning of the light 300. The adapter ring 100 may then be allowed to relax to its uncompressed state such that the ring band 108 is substantially juxtaposed to the inner wall of niche 200. Once the ring band 108 is in communication with the wall of niche 200, the anchor screws 101 may be employed to secure the ring band 108 into its preferred position. When tightened, the anchor screws 101 may extend outward from the ring band 108 until each is secured against the niche 200 wall, thereby fixing the pool light adapter ring 100 in position. Once the adapter ring 100 is anchored inside of niche 200, a user may leverage the pool light adapter ring 100 as a secure and rigid mounting structure for receipt of a pool light 300 or other device.

Figure 3:
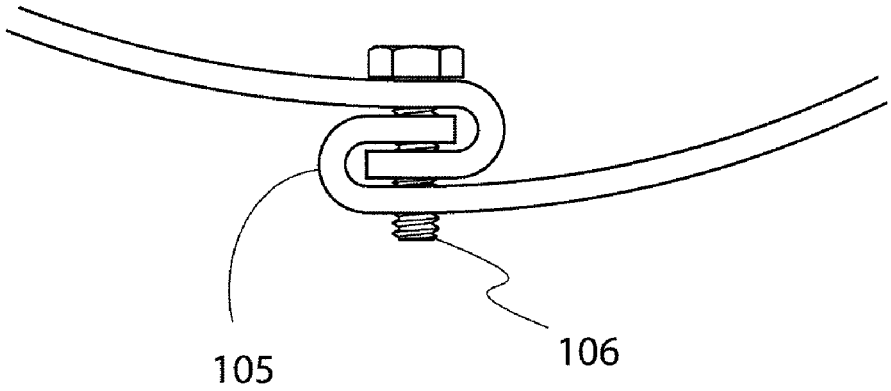
FIG. 3 is a detail view of an exemplary interlocking hook feature included in the exemplary embodiment of FIG. 1.

FIG. 3 is a detail view of an exemplary set of interlocking hooks included in the exemplary embodiment of FIG. 1. The ring band 108 may have an opening at one location along the ring band 108 to allow the ring band 108 to be compressed to a size smaller than the full diameter. When the interlocking hooks are disconnected and the ring band 108 is compressed into a compressed state, the ring band 108 may be inserted into a niche that is substantially the same diameter as the ring band 108 when it is in an uncompressed state. As described above, the opposing ends of the opening of the ring band 108 may be connected via a pair of interlocking hooks 105 and secured with a retaining bolt 106 that is threaded or inserted through complimentary, aligned orifices in the centers of the hooks 105.

Figure 4:
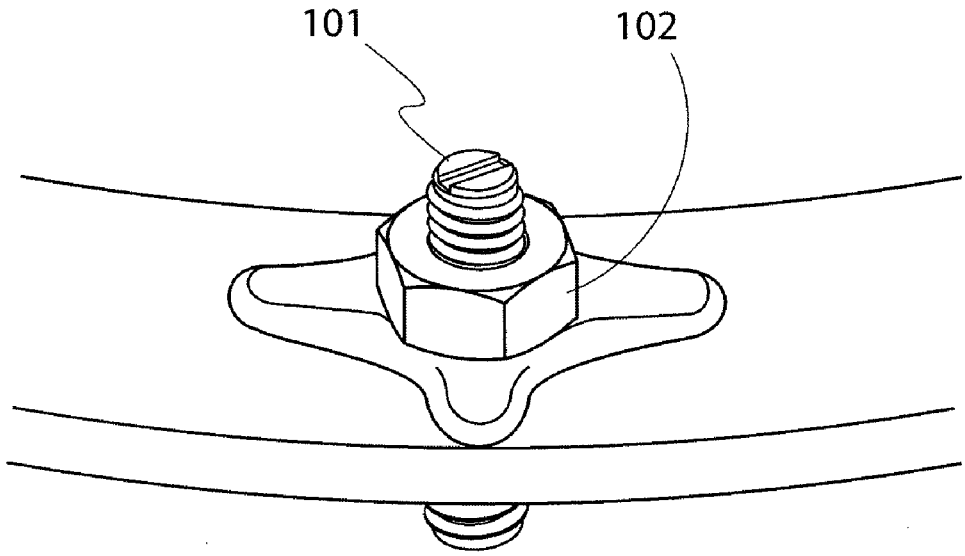
FIG. 4 is a detail view of an exemplary anchor screw feature included in the exemplary embodiment of FIG. 1.

FIG. 4 is a detail view of an exemplary anchor screw included in the exemplary embodiment of FIG. 1. The anchor screws 101 may be screwed through threaded holes 102 extending through the flat surface of the ring band 108. A threaded hole 102 may be constructed of a nut that will mate to the screw pattern of the anchor screw 101, although use of a nut is not required in all embodiments. In those embodiments that use a nut component for receipt of an anchor screw 101, the nut 102 may be affixed to the ring band 108 by welding, casting, or any other method which will provide a secure and accessible housing for the anchor screws 101. When tightened, the anchor screws 101 may extend outward from the ring band 108 until in secure contact with the niche 200 wall.

Figure 5:
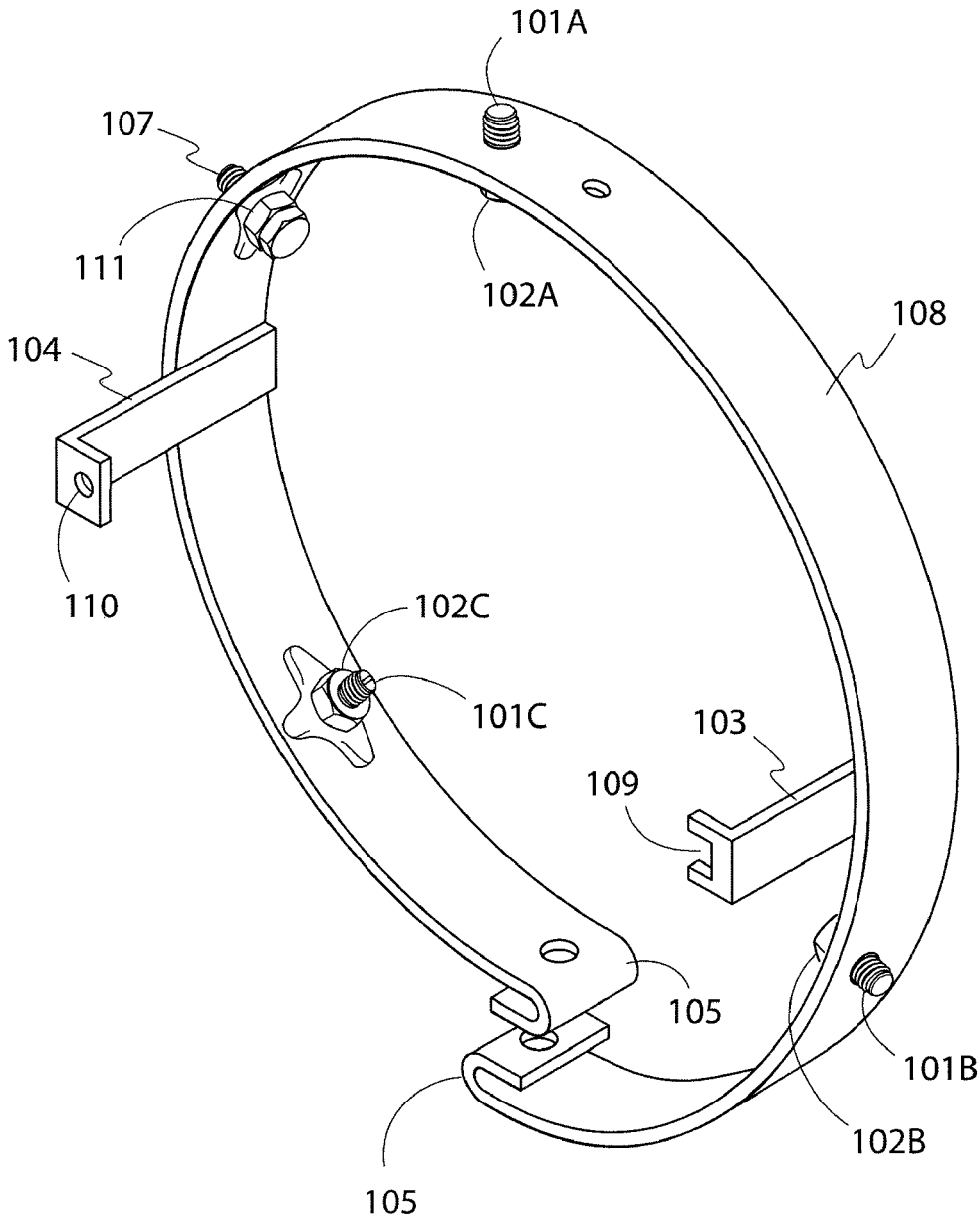
FIG. 5 is a perspective view of the exemplary pool light adapter ring of FIG. 1, shown in a compressed state.

FIG. 5 is a perspective view of a pool light adapter ring 100 according to an exemplary embodiment of the invention, shown in a compressed state. When the interlocking hooks 105 of the pool light adapter ring 100 are decoupled, the ring is no longer locked into a rigid state. As such, the ring band 108 is now capable of being compressed such that the diameter of the ring band 108 may become smaller than the full diameter of the ring band 108 when in its rigid state. When compressed, the ring band 108 may be inserted into a niche 200 that has a diameter substantially the same size as the full diameter of the ring band 108.

To use the exemplary embodiment of the replacement pool light adapter ring 100, a user may employ the following method or a variation thereof. As shown in FIG. 5, the user may reduce the pool light adapter ring 100 from its rigid state and into its compressed state by removing the retaining bolt 106 and decoupling the interconnected hook ends 105. After compressing, the ring band 108 may be positioned in the niche 200 such that the bracket 104 with the bolt hole 110 will be located at the top of the ring band 108 as it inserts into a niche 200 located on a vertical wall. The bracket 103 with the notch 109, which in the exemplary embodiment is mounted opposite the bracket 104 with the bolt hole 110, may be located at the bottom of the ring band 108.

Further, the ring band 108 may be inserted into the niche 200 to a depth such that the completely installed lighting fixture including light 300 is substantially flush with the vertical wall of the pool. After the ring band 108 is inserted to the proper depth, the ring band 108 may next be returned to the rigid state by the user by allowing the ring band 108 to relax to its uncompressed state, thereby coupling the interlocking hooks 105 on the open ends of the ring band 108. The interlocking hooks 105 may then be secured by screwing in a bolt 106 through the aligned holes located in the center of the engaged hooks. The anchor screws 101 may be driven through the surface of the ring band 108 and into or against the niche 200 wall to secure the replacement pool light adapter ring 100 in place. The user may then attach the grounding wire provided by the pool light 300 to the grounding screw 107 that is located on the ring band 108 by compressing the grounding wire between the bolt head 107 and the mating surface of the retaining nut 111. After the ring is properly secured in the niche, the user may then install the light 300.

Thus, one preferred embodiment of the light adapter ring 100 for mounting a light 300 in a wall niche 200 comprises a discontinuous, flexible band 108 substantially defining a hoop and having a first end and a second end; one or more bracket components 103, 104 configured to receive a pool light 300; and a plurality of anchor screw elements 101 positioned at increments along the band 108 and configured to be translated from a first, retracted position to a second, extended position, wherein translation from the first position to the second position is radially outward from the band 108; wherein the first and second ends 105 are configured to couple and decouple such that the band 108 may be compressed into a first, compressed state when the ends 105 are decoupled and relaxed into a second, rigid state when the ends 105 are coupled.

The pool light adapter ring 100 can be used as an initial installation for mounting a light 300 or other fixture within niches 200 of a pool wall. Alternatively, the pool light ring adapter 100 can be used in a retrofit manner for mounting a light 300 or other fixture within niches structurally larger than the light 300 or other fixture, such as in situations where the pool owner desires to change fixtures. Also alternatively, the pool light ring adapter 100 can be used in a retrofit manner when the niche 200 has been compromised or otherwise disrupted, altered, or broken.

Systems, devices and methods for the pool light adapter ring have been described using detailed descriptions of embodiments thereof that are provided by way of example and are not intended to limit the scope of the disclosure. The described embodiments comprise different features, not all of which are required in all embodiments of a pool light adapter ring. Some embodiments of a pool light adapter ring utilize only some of the features or possible combinations of the features. Variations of embodiments of a pool light adapter ring that are described and embodiments of a pool light adapter ring comprising different combinations of features noted in the described embodiments will occur to persons of the art.

It will be appreciated by persons skilled in the art that systems, devices and methods for the provision of a pool light adapter ring is not limited by what has been particularly shown and described herein above. Rather, the scope of systems, devices and methods for the provision of a pool light adapter ring is defined by the attached claims.

What is claimed is:

1. A light adapter ring for mounting a light in a wall niche, the light adapter ring comprising:

a discontinuous, flexible band substantially defining a hoop and having a first end and a second end;

at least one bracket component configured to receive a light; and at least one anchor screw elements positioned at increments along the band and configured to be translated from a first, retracted position to a second, extended position, wherein translation from the first position to the second position is radially outward from the band;

wherein the first and second ends are configured to couple and decouple such that the band may be compressed into a first, compressed state when the ends are decoupled and relaxed into a second, rigid state when the ends are coupled.

2. The light adapter ring of claim 1, further comprising a component configured for receipt of an electrical grounding wire.

3. The light adapter ring of claim 1 further comprising a bolt component for securing the coupling of the first and second ends, wherein the first and second ends of the discontinuous, flexible band are configured to receive the bolt component.

4. The light adapter ring of claim 1, wherein the first and second ends of the discontinuous, flexible band each comprise a hook, and wherein the hooks cooperate with each other for forming the hoop.

5. The light adapter ring of claim 1, wherein the discontinuous, flexible band is comprised of a stainless steel.

6. The light adapter ring of claim 1, wherein the discontinuous, flexible band is comprised of a plastic.

7. The light adapter ring of claim 1, wherein the discontinuous, flexible band is comprised of fiberglass.

8. The light adapter ring of claim 1, wherein the discontinuous, flexible band is comprised of a ceramic material.

9. The light adapter ring of claim 1, wherein the at least one anchor screw element is translated via a threading mechanism.

10. A light adapter ring for mounting a light in a wall niche, the light adapter ring comprising:

a discontinuous, flexible band substantially defining a hoop and having a first end and a second end;

at least two bracket components configured to receive a light; and at least three anchor screw elements positioned at increments along the band and configured to be translated from a first, retracted position to a second, extended position, wherein translation from the first position to the second position is radially outward from the band;

wherein the first and second ends are configured to couple and decouple such that the band may be compressed into a first, compressed state when the ends are decoupled and relaxed into a second, rigid state when the ends are coupled.

11. The light adapter ring of claim 10, further comprising a component configured for receipt of an electrical grounding wire.

12. The light adapter ring of claim 1 further comprising a bolt component for securing the coupling of the first and second ends, wherein the first and second ends of the discontinuous, flexible band are configured to receive the bolt component.

13. The light adapter ring of claim 10, wherein the first and second ends of the discontinuous, flexible band each comprise a hook, and wherein the hooks cooperate with each other for forming the hoop.

14. The light adapter ring of claim 10, wherein the discontinuous, flexible band is comprised of a stainless steel.

15. The light adapter ring of claim 10, wherein the discontinuous, flexible band is comprised of a plastic.

16. The light adapter ring of claim 10, wherein the discontinuous, flexible band is comprised of fiberglass.

17. The light adapter ring of claim 10, wherein the discontinuous, flexible band is comprised of a ceramic material.

18. The light adapter ring of claim 10, wherein the at least one anchor screw element is translated via a threading mechanism.

19. A method for installing a light into a wall niche, the method comprising the steps of:

a) obtaining a light adapter ring comprising:

a discontinuous, flexible band substantially defining a hoop and having a first end and a second end;

one or more bracket components configured to received a pool light; and a plurality of anchor screw elements positioned at increments along the band and configured to be translated from a first, retracted position to a second, extended position, wherein translation from the first position to the second position is radially outward from the band;

wherein the first and second ends are configured to couple and decouple such that the band may be compressed into a first, compressed state when the ends are decoupled and relaxed into a second, rigid state when the ends are coupled;

b) placing the light adapter ring into the first, compressed state;

c) inserting the light adapter ring into the wall niche;

d) allowing the light adapter ring to relax into the second, rigid state such that the first and second ends couple;

e) translating each of the plurality of anchor elements from the first, retracted position to the second, extended position, wherein translation of the anchor elements to the second, extended position serves to rigidly fix the light adapter ring in the wall niche; and f) mounting the light to the one or more bracket components of the light adapter ring.

* * * * *